US011028505B1

(12) United States Patent
Lambert

(10) Patent No.: US 11,028,505 B1
(45) Date of Patent: Jun. 8, 2021

(54) PROTECTIVE APPAREL

(71) Applicant: Jeffrey Lambert, McKinney, TX (US)

(72) Inventor: Jeffrey Lambert, McKinney, TX (US)

( * ) Notice: Subject to any disclaimer, the term of this patent is extended or adjusted under 35 U.S.C. 154(b) by 144 days.

(21) Appl. No.: 16/221,963

(22) Filed: Dec. 17, 2018

(51) Int. Cl.
*D03D 1/00* (2006.01)
*G21F 3/02* (2006.01)
*A41D 13/008* (2006.01)

(52) U.S. Cl.
CPC ..... *D03D 1/0058* (2013.01); *A41D 13/008* (2013.01); *G21F 3/02* (2013.01); *D10B 2101/20* (2013.01)

(58) Field of Classification Search
CPC ..... D03D 1/00
See application file for complete search history.

(56) References Cited

U.S. PATENT DOCUMENTS 4,196,355 A 4/1980 Maine
4,825,877 A * 5/1989 Kempe ..... A41D 31/00 128/846
5,103,504 A * 4/1992 Dordevic ..... A41D 13/008 2/243.1
6,146,351 A * 11/2000 Kempe ..... A61F 13/0273 128/846
2005/0095938 A1* 5/2005 Rosenberger ..... A41D 31/265 442/194
2006/0062944 A1* 3/2006 Gardner ..... F41H 5/0485 428/34.1
2020/0032430 A1* 1/2020 Verstraeten ..... D02G 3/12

* cited by examiner

*Primary Examiner* — Andrew T Piziali
(74) *Attorney, Agent, or Firm* — Sanchelima & Associates, P.A.; Christian Sanchelima; Alexander Rodriguez

(57) ABSTRACT

The present invention is disclosing protective apparel comprising a textile fabric of a defined material. Defined material includes textile clothing fiber embedded with microfilaments of a metal forming a Farady cage around a wearer. Protective apparel blocks electromagnetic and/or radio frequency field waves.

7 Claims, 2 Drawing Sheets

PROTECTIVE APPAREL

BACKGROUND OF THE INVENTION

1. Field of the Invention

The present disclosure relates to protective apparel. More particularly, the present disclosure relates to protective apparel that may be used as a protective gear against electromagnetic frequencies in electromagnetic fields.

2. Description of the Related Art

Typically, human body feels different in harmful radiation areas, such as high-frequency areas, low-frequency areas, or naturally occurring electromagnetic fields (EMF) or radio frequencies (RF). Thus, the body requires to be shielded from such harmful electromagnetic radiation so that the dangerous after-effects could be mitigated.

Several types of such protective apparel have been presented in the past. None of them, however, presents a smart, light-weight, and casual wear protective apparel that is comfortable to wear and at the same time shields the body from the harmful radiations.

Applicant believes that a related reference corresponds to U.S. Pat. No. 4,196,355A by SHIELDING Inc. that discloses a two-piece radiation shield garment for the human body. The two-piece radiation shield garment comprises an adjustably overlapping vest to protect the upper body and a wraparound skirt to protect the lower body. The vest and skirt are constructed of multiple inner layers of flexible radiation shielding material covered with non-shielding fabric or other material. The vest and skirt may be attractively fashioned and decorated to encourage their use as a shield garment for women. The vest includes a rear shield panel joined to a pair of overlapping front shield panels. Similarly, the skirt includes a rear shield panel connected to a pair of overlapping front shield panels. The overlapping front panels of the vest and skirt have wide cooperating horizontal bands of Velcro-type tape closures providing an adjustable fit and a secure closure for the heavy materials. The vest and skirt overlap in the waist region when worn to provide continuous vertical and all-around protection to the body while allowing freedom of movement to the wearer. However, this vest, due to its construction and weight, is much too heavy and uncomfortable to be suitable for normal applications.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide protective apparel that may comprise a textile fabric of a defined material. Defined material may include textile clothing fiber embedded with microfilaments of a metal forming a Farady cage around a wearer that may block electromagnetic field and/or radio frequency waves. Textile fabric may sheath electromagnetic and/or radio frequencies of wearer stimulating body internal communication. In various embodiments, protective apparel may be one of at least a hat, a trench coat, a pant, a shirt, a thermal innerwear, or a hoodie. Further, in various embodiments, protective apparel may be one of at least a plurality of sizes and a plurality of colors.

Metal may be one of at least a designed mu-metal, copper, gold, or such conductive metal or alloy. Protective apparel is antimicrobial. In various embodiments, textile clothing fiber may correspond to one or more of thermoplastic polymers, cotton, and wool. Thermoplastic polymers may correspond to polyethylene.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
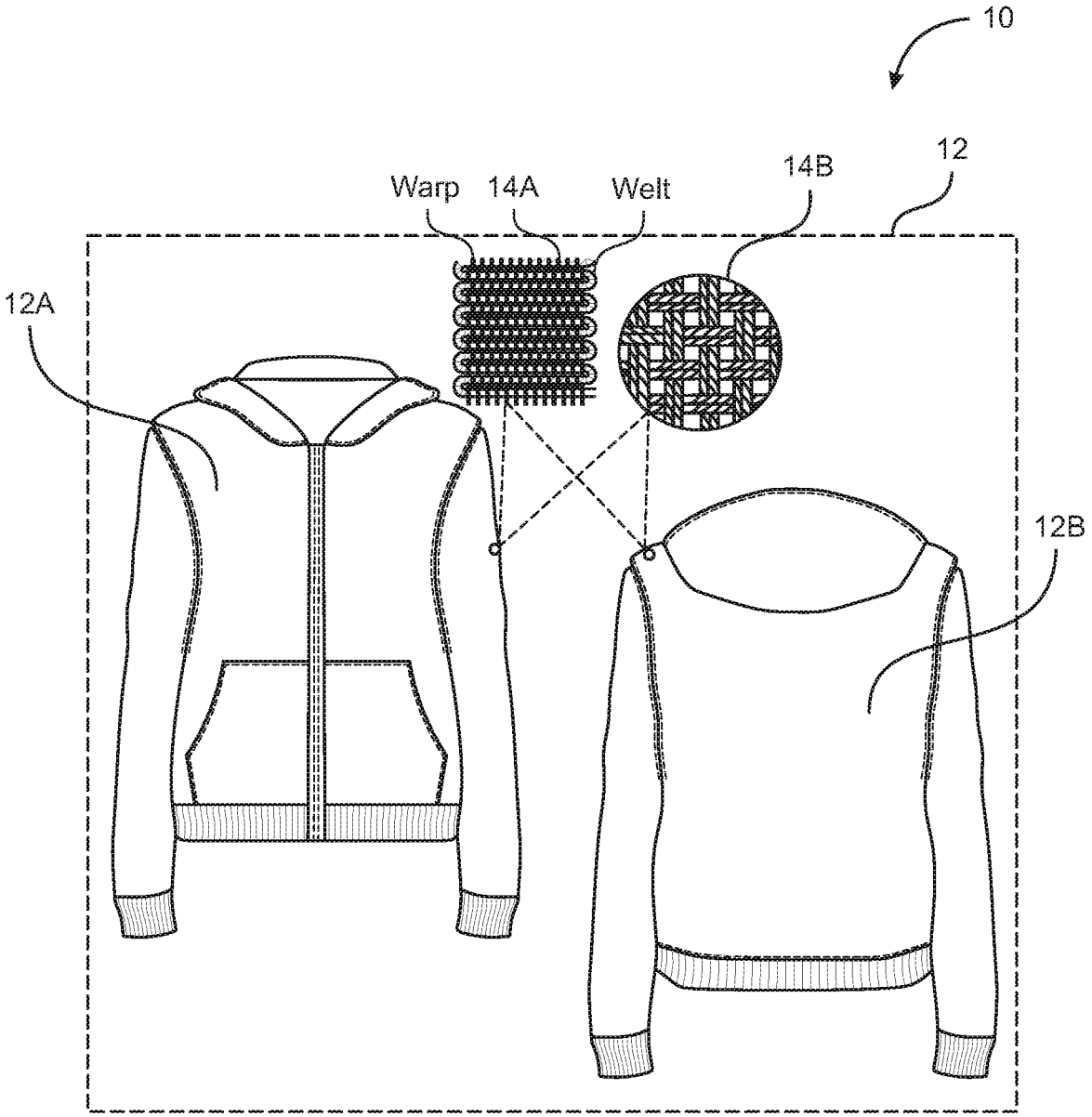
FIG. 1 represents protective apparel 12 of present invention in a first use case 10, according to an embodiment described herein.

Referring now to the drawings, FIGS. 1-2B, where the present invention is generally referred to with numeral 12, it can be observed that protective apparel, in accordance with one embodiment, is provided that includes various components, a described hereinafter.

FIG. 1 represents protective apparel 12 of present invention in a first use case 10, according to an embodiment described herein. Specifically, there are shown a front side 12A and a back side 12B of protective apparel 12, for example a hoodie jacket. Protective apparel 12 may be made up from a textile fabric of a defined material. Defined material may be thermoplastic polymers embedded with microfilaments of a metal, as depicted in microscopic views 14A and 14B.

For shielding body of a wearer against the EMF/RF radiation, textile fabric is woven by orthogonally crossing single warp threads and weft threads, as illustrated in microscopic view 14A, in accordance with an embodiment. Such warp threads and weft threads may be made up of spun mixed yarn thermoplastic polymers, such as polyethylene embedded with microfilaments of a metal. In accordance with another embodiment, as illustrated in microscopic view 14B, there is shown an alternating warp and weft pattern. Such pattern may include double fibers, for example, two weft threads crossing two warp threads. Therefore, textile fabric has quality of fabrics for usual clothing for casual and/or formal wear. In some example, fiber of textile fabric may include polyethylene embedded with microfilaments of copper, gold, or a mu-metal. In other examples though, fiber of textile fabric may include cotton embedded with microfilaments of steel or other such alloy. Thus, such textile fabric when worn by wearer as protective apparel 12 forms a Farady cage around wearer. Thus, protective apparel 12 blocks electromagnetic and/or radio frequency field waves.

In certain embodiments, textile fabric sheaths wearer from electromagnetic and/or radio frequencies against stimulating body internal communication. For example, wearer may have an implanted pacemaker that is typically susceptible to EMF/RF radiation interference. In such cases, EMF/RF radiation interference may stimulate pacemakers that they start malfunctioning that may be very dangerous for wearer. Hence, usage of protective apparel 12 becomes utmost important for such wearers. In various examples, protective apparel 12 may be one of at least a hat, a trench coat, a pant, a shirt, a thermal innerwear, or a hoodie. Further, protective apparel 12 may be one of at least a plurality of sizes and a plurality of colors, as depicted in FIGS. 2 to 2B.

Based on type of base clothing fiber, such as cotton or polyethylene, and fineness (and type as well) of metal microfilaments, effective shielding against excessive or low EMF/RF radiation may be obtained in protective apparel 12. At the same time, it may be ensured that textile fabric is not too stiff to be comfortable worn. For a suitable and effective the shielding effect, it may be required that metal microfilaments are embedded in base clothing fiber in such a manner that a substantial part of metal microfilaments is exposed on the exterior surface of the textile fabric and hence protective apparel 12. Further, sufficient mutual electrical contact of fibers may be achieved in warp and weft threads at crossings to form a Faraday cage. Typically, an average number of the metal microfilaments in the fiber cross-section may be 10 to 15.

As an exemplary embodiment, measurements of such fiber may vary between 5 to 10 micrometers in diameter. Distribution of warp and weft threads in textile fabric and the composition of warp and weft threads may be substantially the same. In certain examples, count of, for example thermoplastic polymers embedded with microfilaments of a metal, in warp and weft direction may be 17 to 20 threads per cm. Fineness of fiber in textile fabric may be in the range of 35 to 45 tex, such that a shielding of 20 to 40 dB against EMF/RF radiation at a frequency of 10 GHz may be established by textile fabric.

Different types of base clothing fibers may offer different advantages. For example, cotton as base clothing fibers may be capable of absorbing moisture and thus, may improve the electrical conductibility with increasing moisture absorption. However, such cotton based textile fabric may be cumbersome to maintain. On the other hand, polyethylene as base clothing fibers may be very light-weight and easy to maintain but absorption capability may be less. Thus, in different working environments, preference for base clothing fibers may be different. For example, in temperature-controlled environments, for example hospitals, polyethylene as base clothing fiber may be preferred. On the other hand, in warehouses, cotton as base clothing fiber may be preferred. However, in all such embodiments, it may be ensured that textile fabric is anti-microbial to prevent against any type of infection.

Figure 2:
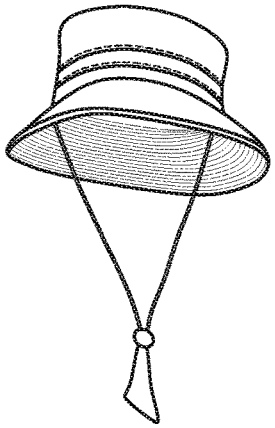
FIGS. 2 to 2B demonstrate various use cases for protective apparel 12, according to various embodiments described herein.
Figure 2A:
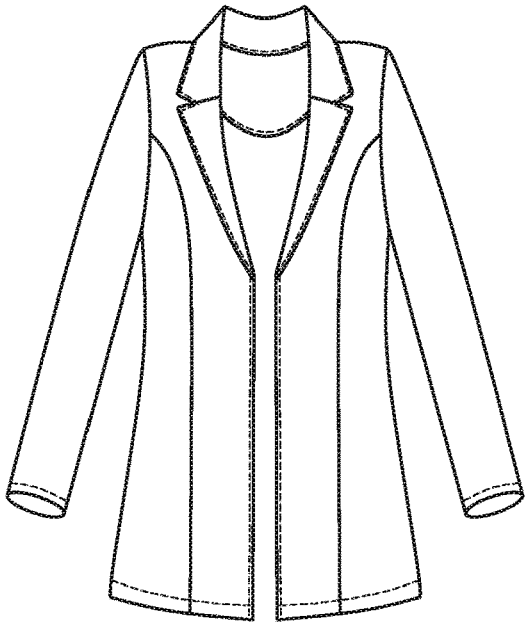
Figure 2B:
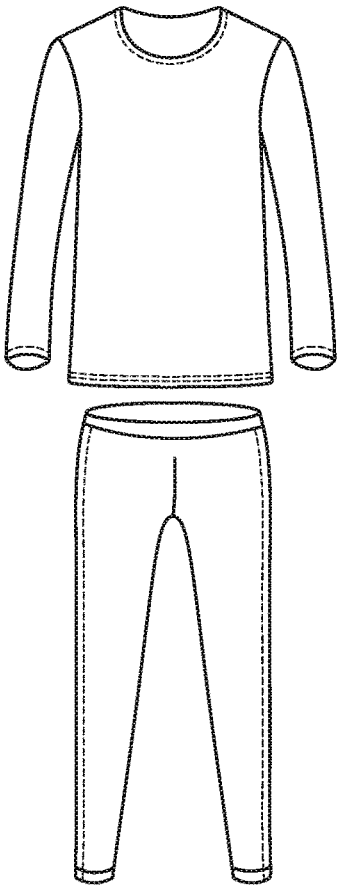

FIGS. 2 to 2B demonstrate various use cases for protective apparel 12, according to various embodiments described herein. For example, in one use case, protective apparel 12 is demonstrated in FIG. 2 as a bucket style hat. In another use case, protective apparel 12 is demonstrated in FIG. 2A as a warm trench coat. In yet another use case, protective apparel 12 is demonstrated in FIG. 2B as underwear thermals. In each of first, second, and third use cases, protective apparel 12 is of a different size and may be of a different color. Stiffness may also be different, for example bucket style hat demonstrated in FIG. 2 may be stiffer as compared to warm trench coat demonstrated in FIG. 2A and underwear thermals demonstrated in FIG. 2B. Further, in each of first, second, and third use cases, protective apparel 12 may be comprising different base textile fibers according to the usage and application area. For example, bucket style hat demonstrated in FIG. 2 may be comprising polyethylene as base textile fibers, warm trench coat demonstrated in FIG. 2A may be comprising wool as base textile fibers, and underwear thermals demonstrated in FIG. 2B may be comprising cotton as base textile fibers.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A fabric, comprising:

a textile fabric of a defined material, wherein said defined material includes textile clothing fibers embedded with microfilaments of a metal forming a Faraday cage around a wearer to serve as a protective apparel, wherein each of said textile clothing fibers are embedded with said microfilaments such that a substantial part of the microfilaments are covered within an exterior surface of the textile fabric, wherein said microfilaments form a mutual electrical contact of fibers to form said Faraday cage, wherein said protective apparel blocks electromagnetic and/or radio frequency field waves, wherein said textile fabric includes a fineness of fiber having a range of 41-45 tex, wherein said clothing fibers are woven by orthogonally crossing single warp threads and weft threads.

2. The fabric of claim 1, wherein said textile fabric sheaths said wearer from electromagnetic and/or radio frequencies against stimulating body internal communication.

3. The fabric of claim 1, wherein said fabric is an apparel that is one of at least a hat, a trench coat, a pant, a shirt, a thermal innerwear, or a hoodie.

4. The fabric of claim 1, wherein said metal is one of at least a designed mu-metal, copper, gold, conductive metal, or alloy.

5. The fabric of claim 1, wherein said fabric is a protective apparel that is antimicrobial.

6. The fabric of claim 1, wherein said textile clothing fibers comprise one or more of thermoplastic polymers, cotton, and wool.

7. The fabric of claim 6, wherein said thermoplastic polymers comprise polyethylene.

* * * * *